US007787630B2

(12) United States Patent
Lerner et al.

(10) Patent No.: US 7,787,630 B2
(45) Date of Patent: Aug. 31, 2010

(54) FM STEREO DECODER INCORPORATING COSTAS LOOP PILOT TO STEREO COMPONENT PHASE CORRECTION

(75) Inventors: Gregory Lerner, Petach Tikva (IL); Nir Tal, Haifa (IL); Ofer Friedman, Yehud (IL)

(73) Assignee: Texas Instruments Incorporated, Dallas, TX (US)

( * ) Notice: Subject to any disclaimer, the term of this patent is extended or adjusted under 35 U.S.C. 154(b) by 1050 days.

(21) Appl. No.: 11/464,871

(22) Filed: Aug. 16, 2006

(65) Prior Publication Data

US 2007/0047737 A1 Mar. 1, 2007

Related U.S. Application Data

(60) Provisional application No. 60/712,158, filed on Aug. 29, 2005.

(51) Int. Cl.
*H04H 20/47* (2008.01)

(52) U.S. Cl. ..... 381/2; 381/3; 381/6; 381/14; 381/16; 381/22; 455/260

(58) Field of Classification Search ..... 381/2–3, 381/6, 14, 16, 22; 455/260
See application file for complete search history.

(56) References Cited

U.S. PATENT DOCUMENTS 5,507,024 A * 4/1996 Richards, Jr. ..... 455/260
5,526,284 A * 6/1996 Mankovitz ..... 455/66.1
5,561,849 A * 10/1996 Mankovitz ..... 455/45
7,149,312 B1 * 12/2006 Wildhagen ..... 381/2
7,295,631 B2 * 11/2007 Wildhagen ..... 375/316

* cited by examiner

*Primary Examiner*—Xu Mei
*Assistant Examiner*—Disler Paul
(74) *Attorney, Agent, or Firm*—Ronald O. Neerings; Wade James Brady, III; Frederick J. Telecky, Jr.

(57) ABSTRACT

A novel system and method for correcting the residual phase offset between a recovered pilot signal and the received stereo signal. The invention uses a Costas loop as an auxiliary loop in addition to the pilot recovery phase locked loop (PLL) to lock onto the stereo component itself. This auxiliary loop functions to generate a pilot to stereo component phase correction signal that is added to the stereo carrier phase The resultant phase is used to generate the recovered pilot carrier used to demodulate the stereo MPX signal. The Costas loop is activated together with the main pilot recovery PLL that locks onto the pilot tone in the demodulated MPX signal. The auxiliary Costas loop is operative to track and determine a residual phase error of up to several degrees.

22 Claims, 7 Drawing Sheets

FM STEREO DECODER INCORPORATING COSTAS LOOP PILOT TO STEREO COMPONENT PHASE CORRECTION

REFERENCE TO PRIORITY APPLICATION

This application claims priority under 35 U.S.C. §119(e) to U.S. Provisional Application Ser. No. 60/712,158, filed Aug. 29, 2005, entitled "FM Stereo (MPX) Decoder Phase-Locked Loop (PLL)," incorporated herein by reference in its entirety.

FIELD OF THE INVENTION

The present invention relates to the field of communications and more particularly relates to an FM stereo (MPX) decoder incorporating a pilot recovery phase locked loop (PLL) with an auxiliary Costas loop based pilot to stereo component phase correction circuit able to achieve improved stereo channel separation.

BACKGROUND OF THE INVENTION

FM stereo demodulation techniques, having been developed in the 1930s, are well known in the art. The signal transmitted over the air is referred as the FM stereo MPX signal. A diagram illustrating the spectral components of a conventional FM stereo MPX signal is shown in FIG. 1. A stereo signal is constructed at the FM transmitter by taking the sum and difference of the left (L) and right (R) channels and transmitting both along with a pilot carrier. The sum signal is referred to as the mono component and the difference signal is referred to as the stereo component. The mono component is sent baseband while the stereo component is modulated by a 38 kHz stereo carrier that is suppressed in the transmitted signal. The final spectrum, generally referenced 10, thus comprises a baseband mono signal portion 12 (i.e. L+R) for compatibility with radios not able to decode the stereo signal, a 19 kHz pilot carrier tone 14, a stereo signal portion 16 (L−R), centered at 38 kHz, that must first be decoded at the receiver and an optional Radio Data System (RDS) signal 18 centered at 57 kHz.

Prior art FM stereo demodulation is achieved by extracting two audio signal paths from the MPX (FM stereo) signal. The demodulation is assisted by the FM stereo indication pilot carrier 16 located at 19 kHz. A stereo decoder takes the demodulated signal and regenerates the stereo component carrier using a phased locked loop (PLL) locked on the pilot tone. It then uses this carrier for demodulation of the stereo audio component (i.e. L−R signal).

A block diagram illustrating an example prior art stereo decoder circuit is shown in FIG. 2. The stereo decoder, generally referenced 20, comprises a phase locked loop 22, mixer 26, stereo signal path low pass filter 28, mono signal path low pass filter 32, summer 30 and difference block 34. The pilot recovery PLL 22 comprises a multiplier 23, low pass filter 25, loop filter 27, voltage controller oscillator (VCO)/numerically controlled oscillator (NCO) 29 and divided by two block 31.

In operation, the MPX stereo signal is input to two paths: a stereo path and a mono path. In the mono path, the MPX signal is simply low pass filtered by LPF 32 which functions to pass the M=L+R mono signal component. In the stereo path, the MPX signal is input to the pilot recovery PLL which functions to recover the stereo carrier from the 19 kHz pilot tone. The MPX signal is multiplied by the quadrature of the recovered pilot tone via multiplier 23. The product then undergoes low pass filtering via LPF 25. This operation generates a signal proportional to the phase error between the reconstructed pilot carrier and the MPX pilot signal. This phase error signal then undergoes loop filtering via loop filter 27 in order to achieve smoothing of unwanted transients. The output of the loop filter is the frequency deviation input to the VCO block 29. The output of the VCO block is the regenerated stereo carrier used to demodulate the stereo signal. The frequency of the recovered stereo carrier signal is also divided by 2 via block 31 and is used to close the loop.

The 38 kHz pilot tone output of the VCO is multiplied with the MPX signal via multiplier 26. The resulting product is then low pass filtered via LPF 28 which functions to pass the S=L−R stereo signal component. The sum and difference of the S and M signals are then generated via summer 30 and difference block 34 to yield the left and right audio channels, respectively.

As described above, a conventional stereo FM radio signal contains a pilot carrier that is used to reconstruct the stereo carrier (which was suppressed at the transmitter) which is then used to modulate the stereo component of the FM signal. The stereo channel separation performance of a stereo FM receiver is limited by the phase accuracy of the reconstructed stereo carrier signal. The stereo carrier phase inaccuracy is expressed as the phase offset between the recovered pilot carrier and the actual true stereo carrier. The phase offset is typically caused by non-idealities at both the transmitter and the receiver. Thus, if there is a phase (i.e. angle) difference between the phase of the transmitted pilot and the stereo pilot used to modulate the stereo component, the full stereo S signal cannot be generated at the receiver. Ideally, the phase difference is zero which permits high stereo separation between L and R channels since the full amplitude of S can be generated. In reality, however, this is not possible.

The stereo FM modulation standard ITU-R recommendation BS.450-3, "Transmission standards for FM sound broadcasting at VHF," ITU, 1982-1995-2001, allows for a phase inaccuracy in the stereo pilot of up to 3 degrees. Such a phase offset will cause a phase offset of up to 6 degrees on the stereo component carrier, whose frequency is twice that of the pilot frequency. In practice, however, numerous commercial FM broadcast stations exhibit an even greater phase offset then 3 degrees between the stereo indication pilot and the stereo component carrier.

Such a phase offset limits the amount of stereo channel separation the MPX decoder is able to achieve when using the classical phased locked loop (PLL) to recover the stereo carrier from the transmitted pilot wave. The problem is expressed mathematically below.

Consider a transmitted signal y(t):

$$y(t)=M(t)+\sin(\omega t+\Delta\theta)+S(t)\sin(2\omega t) \quad (1)$$

where

M(t) is the mono component (i.e. Left+Right audio)

S(t) is the stereo component (i.e. Left−Right audio)

ωt is the stereo indication pilot phase (i.e. 19 kHz)

If the pilot recovery PLL completely restores the pilot phase, the estimated stereo component will be as follows:

$$S_{est}(t)=LPF\cdot\{y(t)\sin(2\omega t+2\Delta\theta)\} \quad (2)$$

where

LPF is the output of the low pass filter applied to filter out the higher frequency components created by mixing down the stereo component.

Further analysis yields:

$$\begin{aligned} y(t)\sin(2\omega t + 2\Delta\theta) &= M(t)\sin(2\omega t + 2\Delta\theta) + \\ &\quad \sin(\omega t + \Delta\theta)\sin(2\omega t + 2\Delta\theta) + \\ &\quad S(t)\sin(2\omega t)\sin(2\omega t + 2\Delta\theta) \\ &= M(t)\sin(2\omega t + 2\Delta\theta) + \\ &\quad \sin(\omega t + \Delta\theta)\sin(2\omega t + 2\Delta\theta) + \\ &\quad \frac{1}{2}S(t)\cos(2\Delta\theta) + \frac{1}{2}S(t)\cos(4\omega t + 2\Delta\theta) \end{aligned} \tag{3}$$

The signal is passed through a low pass filter which leaves only the 'baseband' components, as follows:

$$S_{est}(t) = \frac{1}{2}S(t)\cos(2\Delta\theta) \approx \frac{1}{2}S(t)\left(1 - \frac{(2\Delta\theta)^2}{2}\right) \tag{4}$$

The ITU cited supra defines stereo separation as the following. First, an audio signal is transmitted on the Left audio channel only. Then, the relation between the desired signal received on the Left channel to the signal leakage on the Right channel is the stereo separation.

Thus, in this example, we have:

$$M(t)=S(t)=L \tag{5}$$

The desired signal at the Left channel will be:

$$\begin{aligned} L &= \frac{1}{2}(M(t) + 2\cdot S_{est}(t)) \\ &\approx \frac{1}{2}M(t)\left(1 + 1 - \frac{(2\Delta\theta)^2}{2}\right) \\ &\approx M(t) \end{aligned} \tag{6}$$

Similarly, the leakage signal on the Right channel will be:

$$\begin{aligned} R &= \frac{1}{2}(M(T) - 2\cdot S_{est}(t)) \\ &\approx \frac{1}{2}M(t)\left(1 - 1 + \frac{(2\Delta\theta)^2}{2}\right) \\ &\approx \frac{1}{4}M(t)(2\Delta\theta)^2 \\ &= M(t)(\Delta\theta)^2 \end{aligned} \tag{7}$$

The total stereo separation is therefore limited by:

$$MaxSeparation < 20\log_{10}\left(\frac{L}{R}\right) \approx 40\log_{10}(\Delta\theta) \tag{8}$$

Thus, for example, for a phase offset of 3 degrees the stereo separation is limited to 51 dB. A phase offset of just 15 degrees, however, limits the separation to only 23 dB.

Note that the use of narrow-band loop filters in the receiver PLL to improve the total stereo audio quality raises the maximum possible instantaneous phase offset. Note also that most FM radio manufactures assume an ideal transmitted signal and attempt to improve the pilot recovery at the receiver. This, however, is not the case as the ITU allows for a small phase offset, thus leading to lower stereo separation.

There is thus a need for a mechanism that overcomes the disadvantages of the prior art. In particular, there is a need for a FM stereo decoder that is able to improve the stereo separation in an FM stereo radio without degrading the performance of the radio and without significantly increasing the cost and complexity of the radio.

SUMMARY OF THE INVENTION

The present invention is a system and method for correcting the residual phase offset between the recovered pilot and the stereo signal. The invention achieves this through the use of an additional loop that locks onto the stereo component itself and which functions to generate a pilot to stereo component phase correction signal. This phase correction signal is added to the recovered stereo carrier phase which is used to generate the recovered stereo pilot carrier. The received MPX signal is multiplied by the recovered stereo pilot carrier to generate the stereo L−R component.

In the example embodiment presented herein, a Costas loop is used generate the pilot to stereo component phase correction signal. Such a loop is activated together with the main pilot recovery PLL that locks onto the pilot tone in the demodulated MPX signal. The loop bandwidth of the Costas loop is significantly narrower than that of the pilot recovery PLL in order that the pilot recovery PLL does not interfere with the Costas loop. The auxiliary Costas loop is thus operative to track and determine a residual phase error of up to several degrees.

Several advantages of the stereo decoder of the present invention comprising a Costas loop include: (1) the stereo separation achieved by FM radios constructed with the stereo decoder of the present invention significantly outperform currently known stereo decoding techniques, (2) the stereo decoder of the present invention enable FM radios to achieve high stereo separation even with an ill-conditioned transmitted signal (i.e. when the pilot phase of the transmitted signal significantly differs from the stereo carrier phase caused by poor stereo separation at the FM station transmitter), and (3) requirements on the quality of the pilot tone recovery can be relaxed, resulting in much faster lock times and better tracking with a simpler and less costly design.

Note that some aspects of the invention described herein may be constructed as software objects that are executed in embedded devices as firmware, software objects that are executed as part of a software application on either an embedded or non-embedded computer system such as a central processing unit (CPU), digital signal processor (DSP), microcomputer, minicomputer, microprocessor, etc. running a real-time operating system such as WinCE, Symbian, OSE, Embedded LINUX, etc. or non-real time operating system such as Windows, UNIX, LINUX, etc., or as soft core realized HDL circuits embodied in an Application Specific Integrated Circuit (ASIC) or Field Programmable Gate Array (FPGA), or as functionally equivalent discrete hardware components.

There is thus provided in accordance with the present invention, a method of decoding a stereo MPX signal, the method comprising the steps of recovering a pilot phase signal from the MPX signal, generating a pilot-to-stereo component phase correction signal as a function of a stereo carrier phase signal and the MPX signal, summing the pilot-to-stereo component phase correction signal with a frequency doubled pilot phase signal to yield the stereo carrier phase signal, mixing the MPX signal with the sine of the stereo carrier phase signal to yield a stereo output signal.

There is also provided in accordance with the present invention, a stereo MPX decoder comprising a pilot recovery phase locked loop (PLL) circuit operative to generate a pilot phase error from an input MPX signal, a pilot to stereo component phase recovery circuit operative to extract the phase difference between the MPX signal and a stereo carrier phase signal to yield a pilot to stereo component phase correction signal, an adder for summing the pilot to stereo component phase correction signal with a frequency doubled pilot phase error signal to yield the stereo carrier phase signal and a mixer operative to multiply the MPX signal with the sine of the stereo carrier phase signal to yield a stereo output signal therefrom.

There is further provided in accordance with the present invention, a stereo MPX decoder comprising a phase locked loop (PLL) circuit adapted to generate a pilot phase error from an input MPX signal, a Costas loop circuit coupled to the PLL and operative to generate a phase correction signal representing the phase difference between a received stereo pilot carrier signal and an expected stereo pilot carrier signal, compensating the received pilot carrier signal with the phase correction signal to yield a stereo carrier phase signal and means for generating a stereo output signal as a function of the stereo carrier phase signal and the MPX signal.

There is also provided in accordance with the present invention, a stereo MPX decoder comprising a phase locked loop circuit comprising a pilot tone phase locked loop (PLL) circuit adapted to generate a pilot phase error from an input MPX signal, a Costas loop circuit coupled to the PLL and operative to generate a phase correction signal representing the phase difference between a received stereo pilot carrier signal and an expected stereo pilot carrier signal, compensating the received pilot carrier signal with the phase correction signal to yield a stereo carrier phase signal, means for generating a stereo output signal as a function of the stereo carrier phase signal and the MPX signal, a filter operative to generate a mono output signal from the MPX signal and a stereo blend circuit operative to generate a left output signal and a right output signal from the mono output signal and the stereo output signal.

There is further provided in accordance with the present invention, a frequency modulation (FM) radio comprising an FM demodulator coupled to an antenna and operative to generate an MPX signal from an RF input signal received therefrom, a MPX stereo decoder coupled to the FM demodulator, the MPX stereo decoder comprising a phase locked loop (PLL) circuit adapted to generate a pilot phase error from an input MPX signal, a Costas loop circuit coupled to the PLL and operative to generate a phase correction signal representing the phase difference between a received stereo pilot carrier signal and an expected stereo pilot carrier signal, compensating the received pilot carrier signal with the phase correction signal to yield a stereo carrier phase signal, means for generating a stereo output signal as a function of the stereo carrier phase signal and the MPX signal, filter means for generating a mono output signal from the MPX signal and a stereo blend circuit operative to generate a left output signal and a right output signal from the mono output signal and the stereo output signal.

BRIEF DESCRIPTION OF THE DRAWINGS

The invention is herein described, by way of example only, with reference to the accompanying drawings, wherein.

DETAILED DESCRIPTION OF THE INVENTION

Notation Used Throughout

The following notation is used throughout this document.

| Term | Definition |
|---|---|
| ADC | Analog to Digital Converter |
| AGC | Automatic Gain Control |
| APLL | Analog Phase Locked Loop |
| ASIC | Application Specific Integrated Circuit |
| CIC | Cascaded Integrator-Comb |
| DAC | Digital to Analog Converter |
| DC | Direct Current |
| DPLL | Digital Phase Locked Loop |
| DSP | Digital Signal Processor |
| FM | Frequency Modulation |
| FPGA | Field Programmable Gate Array |
| HDL | Hardware Description Language |
| IF | Intermediate Frequency |
| ITU | International Telecommunications Union |
| LPF | Low Pass Filter |
| MPX | FM Multiplex |
| NCO | Numerically Controlled Oscillator |
| PLL | Phase Locked Loop |
| RDS | Radio Data System |
| RSSI | Received Signal Strength Indication |
| SNC | Stereo Noise Control |
| SNR | Signal to Noise Ratio |
| VCO | Voltage Controlled Oscillator |
| VGA | Variable Gain Amplifier |

The present invention is a system and method for correcting the residual phase offset between the recovered pilot and the stereo signal. The invention achieves this through the use of an additional loop that locks onto the stereo component itself and which functions to generate a pilot to stereo component phase correction signal. This phase correction signal is added to the recovered stereo carrier phase which is used to generate the recovered stereo pilot carrier. The received MPX signal is multiplied by the recovered stereo pilot carrier to generate the stereo L−R component.

In the example embodiment presented herein, a Costas loop is used generate the pilot to stereo component phase correction signal. Such a loop is activated together with the main pilot recovery PLL that locks onto the pilot tone in the demodulated MPX signal. The loop bandwidth of the Costas loop is significantly narrower than that of the pilot recovery PLL in order that the pilot recovery PLL does not interfere with the Costas loop. The auxiliary Costas loop is thus operative to track and determine a residual phase error of up to several degrees.

Figure 1:
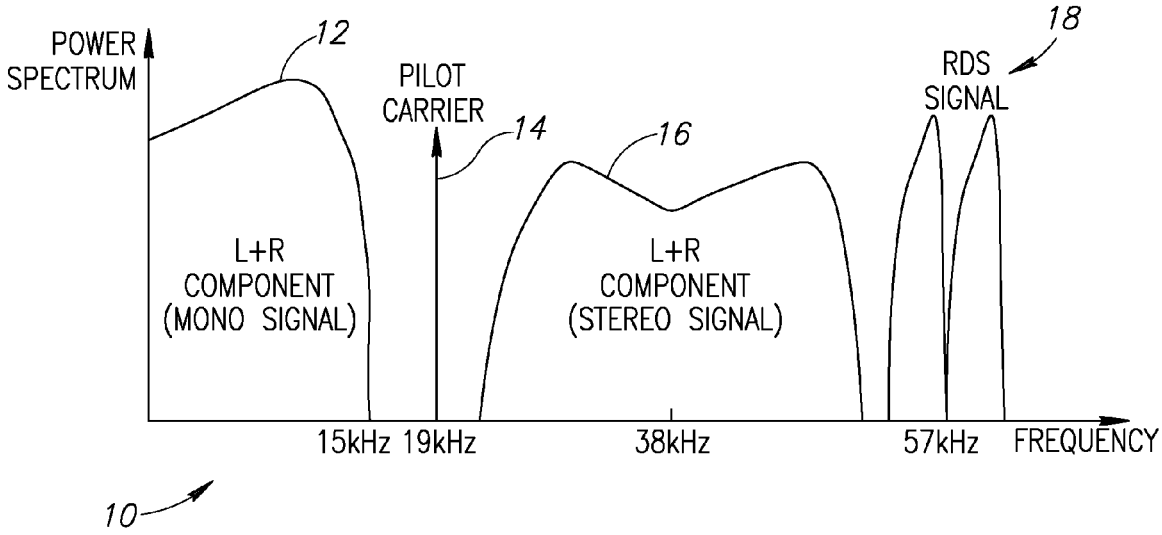
FIG.1 PRIOR ART
FIG. 1 is a diagram illustrating the spectral components of a conventional stereo MPX signal.
Figure 2:
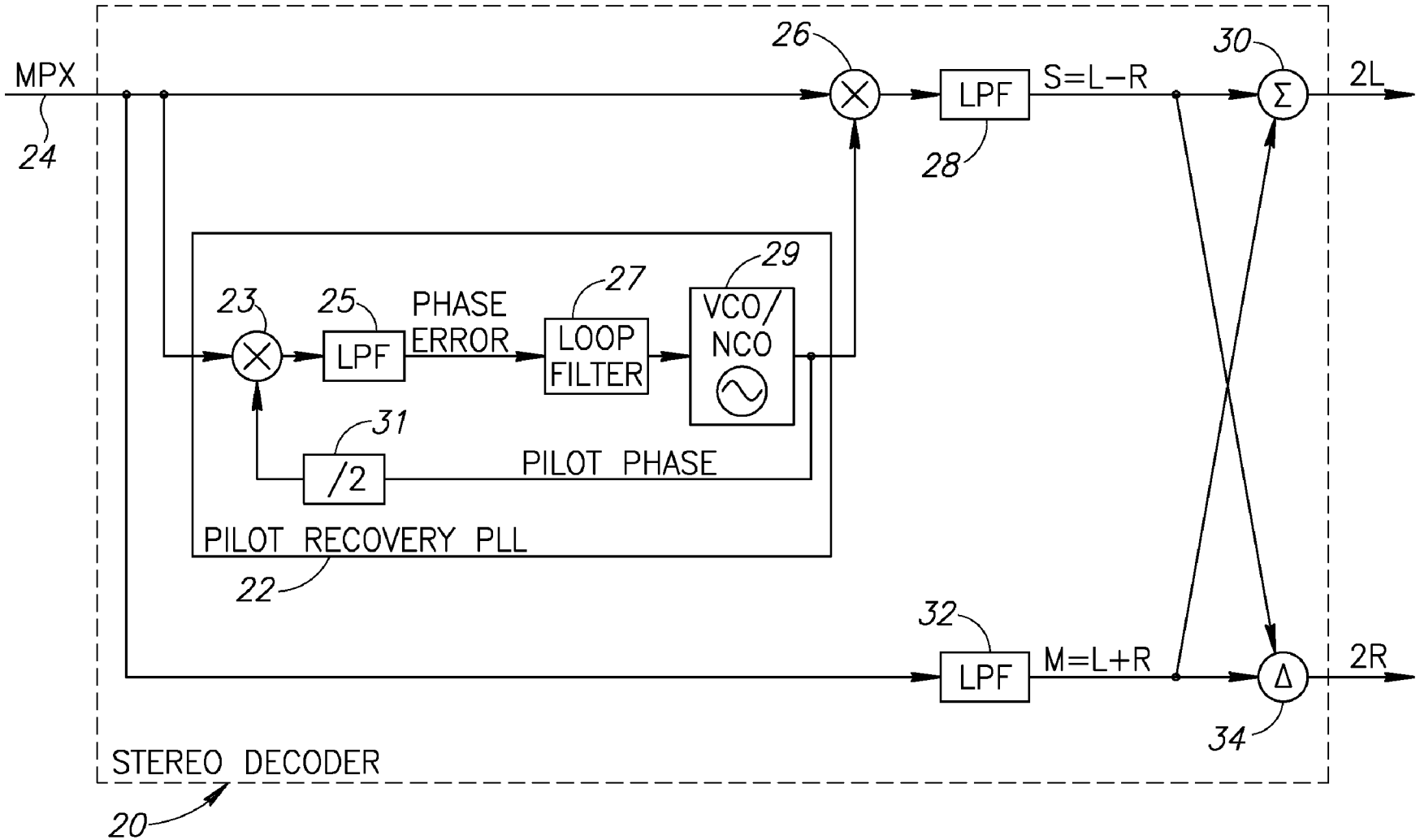
FIG.2 PRIOR ART
FIG. 2 is a block diagram illustrating an example prior art stereo decoder circuit.
Figure 3:
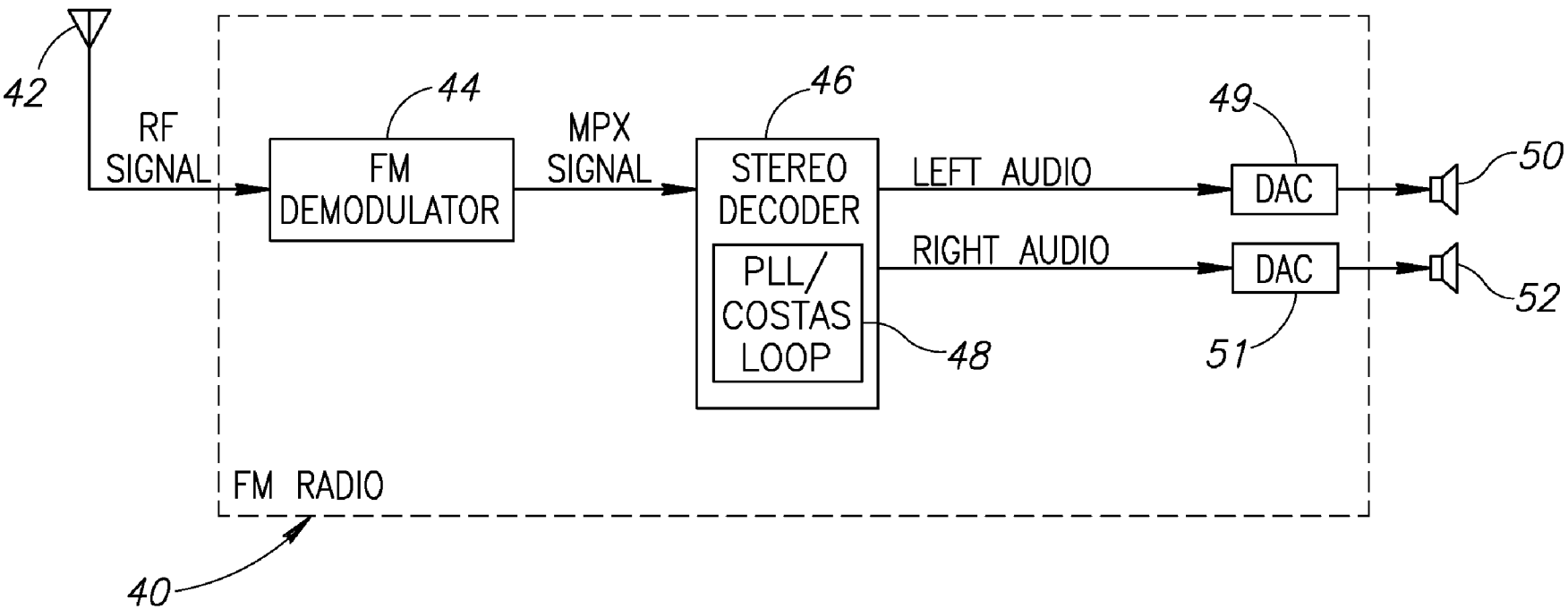
FIG. 3 is a high level block diagram illustrating an example FM radio constructed in accordance with the present invention.

A high level block diagram illustrating an example FM radio constructed in accordance with the present invention is shown in FIG. 3. The example FM radio, generally referenced 40, comprises an antenna 42, FM demodulator 44, stereo decoder 46 incorporating the PLL/Costas loop circuit 48 of the present invention, DACs 49, 51 and speakers 50, 52. In operation, the RF signal received by the antenna is demodulated by the FM demodulator 44. The output of the FM demodulator is an MPX signal having a spectrum similar to that shown in FIG. 1.

The MPX signal is input to the stereo decoder which functions to generate the left and right audio channels. The pilot recovery PLL functions to reconstruct the stereo pilot that was suppressed at the transmitter generate the and auxiliary Costas loop 48 in the stereo decoder function to track and generate a pilot to stereo component phase correction signal that is added to the reconstructed stereo carrier that is used to demodulate the stereo component of the MPX signal. The left audio signal is input to a DAC 49 whose output is fed to left speaker 50. Similarly, the right audio signal is input to a DAC 51 whose output is fed to right speaker 52. Note that any suitable pilot carrier recovery technique may be used with the present invention. The use of a phase locked loop in the embodiments described herein are presented for example purposes only and can be replaced by other suitable pilot carrier recovery techniques, e.g., a narrow bandpass filter, without departing from the scope of the invention.

Figure 4:
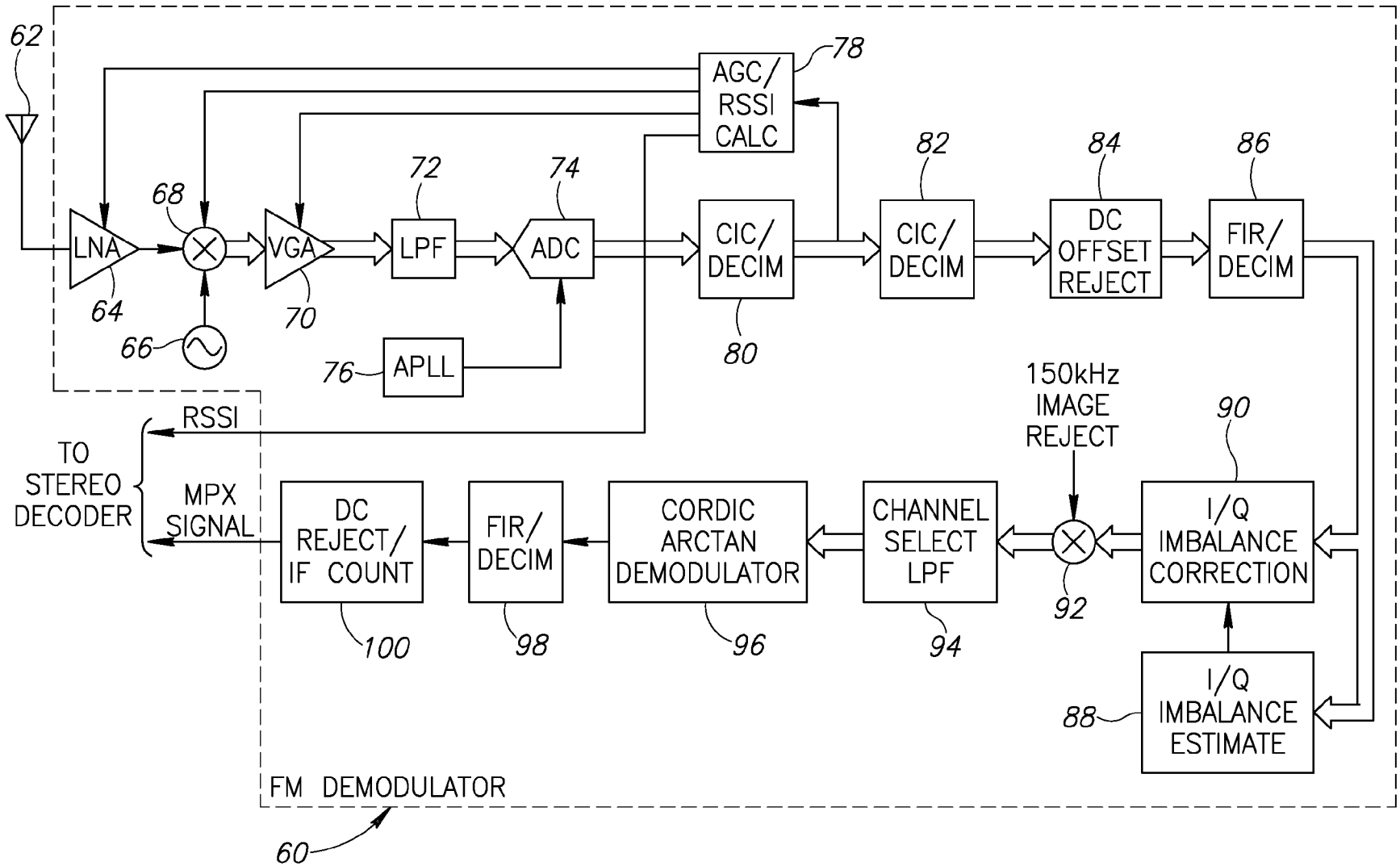
FIG. 4 is a block diagram illustrating the FM demodulator portion of the FM radio of the present invention in more detail.

A block diagram illustrating the FM demodulator portion of the FM radio of the present invention in more detail is shown in FIG. 4. The FM demodulator, generally referenced 60, comprises a low noise amplifier (LNA) 64 coupled to antenna 62, mixer 68, local oscillator 66, variable gain amplifier (VGA) 70, low pass filter (LPF) 72, analog to digital converter (ADC) 74, analog phase locked loop (APLL) 76), cascaded integrator-comb (CIC) decimation filters 80, 82, automatic gain control (AGC)/Received Signal Strength Indication (RSSI) calculation 78, DC offset rejection 84, FIR filter/decimation 86, I/Q imbalance estimation 88, I/Q imbalance correction 90, 150 kHz image reject mixer 92, channel selection LPF 94, arctan demodulator 96, FIR/decimation 98 and DC reject/IF counter 100.

The RF signal from the antenna input is amplified by the LNA, then demodulated to an intermediate frequency (IF) by mixing with the local oscillator. The output of the mixer is enhanced again by the VGA and then low-pass filtered and digitized by the ADC. The digital FM signal is decimated using the CIC filters, demodulated to the baseband via image reject mixer 92, passes through the channel selection filter 94 and is input to the arctan demodulator 96 for FM demodulation. The residual frequency offset is corrected by DC offset rejection circuit 84 and then the MPX signal is decimated again prior to its processing in the stereo decoder block.

Figure 5:
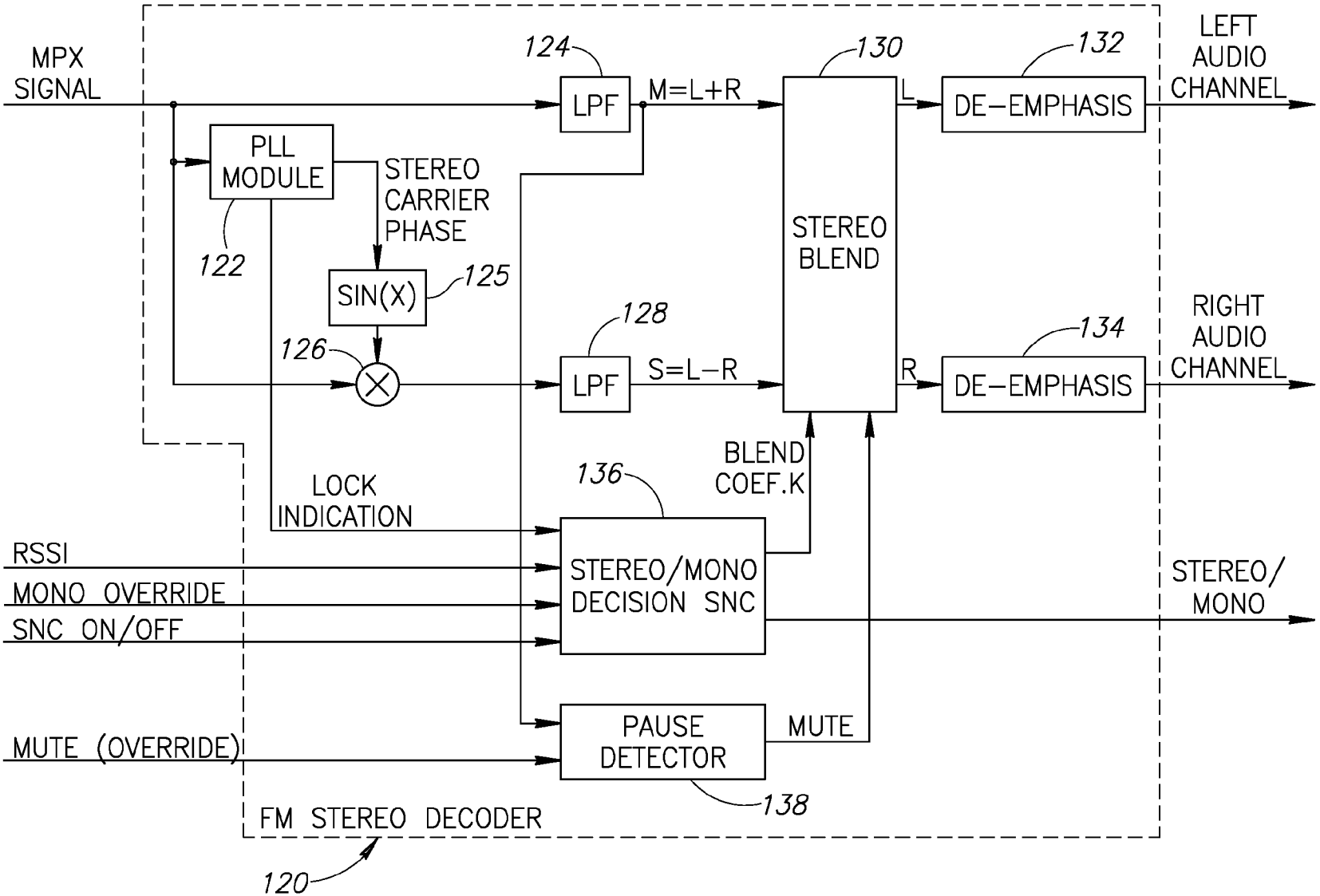
FIG. 5 is a block diagram illustrating an example stereo decoder circuit constructed in accordance with the present invention in more detail.

The FM stereo decoder of the present invention will now be described in more detail. A block diagram illustrating an example stereo decoder circuit constructed in accordance with the present invention in more detail is shown in FIG. 5. The stereo decoder, generally referenced 120, comprises a phase locked loop (PLL) module 122, sine table 125, multiplier 126, low pass filter 124, 128, stereo blend circuit 130, left de-emphasis block 132, right de-emphasis block 134, stereo/mono decision and stereo noise control (SNC) block 136 and pause detector 138.

In operation, the MPX stereo signal output of the FM demodulator is input to the LPF 124, PLL module 122 and multiplier 126. The LPF functions to pass the baseband mono M=L+R component. The PLL module functions to recover the stereo pilot carrier originally suppressed at the FM station transmitter. The stereo carrier phase, output from the PLL module, is input to a high precision sine module 125 adapted to generate the sine function of the stereo carrier phase input which is the stereo pilot carrier signal. The pilot carrier signal is then used to demodulate the stereo component of the MPX signal via multiplier 126 resulting in the M=L−R signal which is then filtered by LPF 128. The resulting M and S signals are input to the stereo blend circuit 130 which functions to take the sum and difference resulting in the left and right audio signals. After de-emphasis blocks 132, 134, the left and right audio channels are converted to analog via DACs 49, 51 (FIG. 3) and fed to speakers 50, 52, respectively.

The stereo/mono decision block functions to determine whether the received signal is a stereo MPX signal. This is achieved by estimating the magnitude of the pilot carrier signal. The product of the input MPX signal and the restored pilot carrier is passed through a low pass α filter comprising a single pole digital filter characterized by the following equation:

$$y_n = y_{n-1} + \alpha(x_n - y_{n-1}) \tag{9}$$

If the filtered output is higher than a threshold, a stereo signal is present, otherwise a mono signal is present. Note that, preferably, two different thresholds are applied to the filter output thus providing some hysteresis.

The lock indication signal is output by the PLL module and is generated by rough estimating the phase error variance at the input to the loop filter in the recovery PLL. The phase error variance is estimated by transferring an absolute value of the phase error through a low pass α filter. Hysteresis in the PLL state switching is achieved by using two different thresholds for the lock indication in similar fashion to the stereo/mono indication circuit described supra.

The mono component of the audio signal is input to the pause detector 138. The pause detector functions to discover silent periods in the audio signal by transferring an absolute value of the audio signal through a single-pole low-pass filter. The smoothed audio level is then compared to a threshold to decide whether there is any audio activity. The silent audio periods may then be used to smoothly switch the RF radio station to an alternate frequency if information regarding alternate frequencies is available from the RDS signal.

Figure 6:
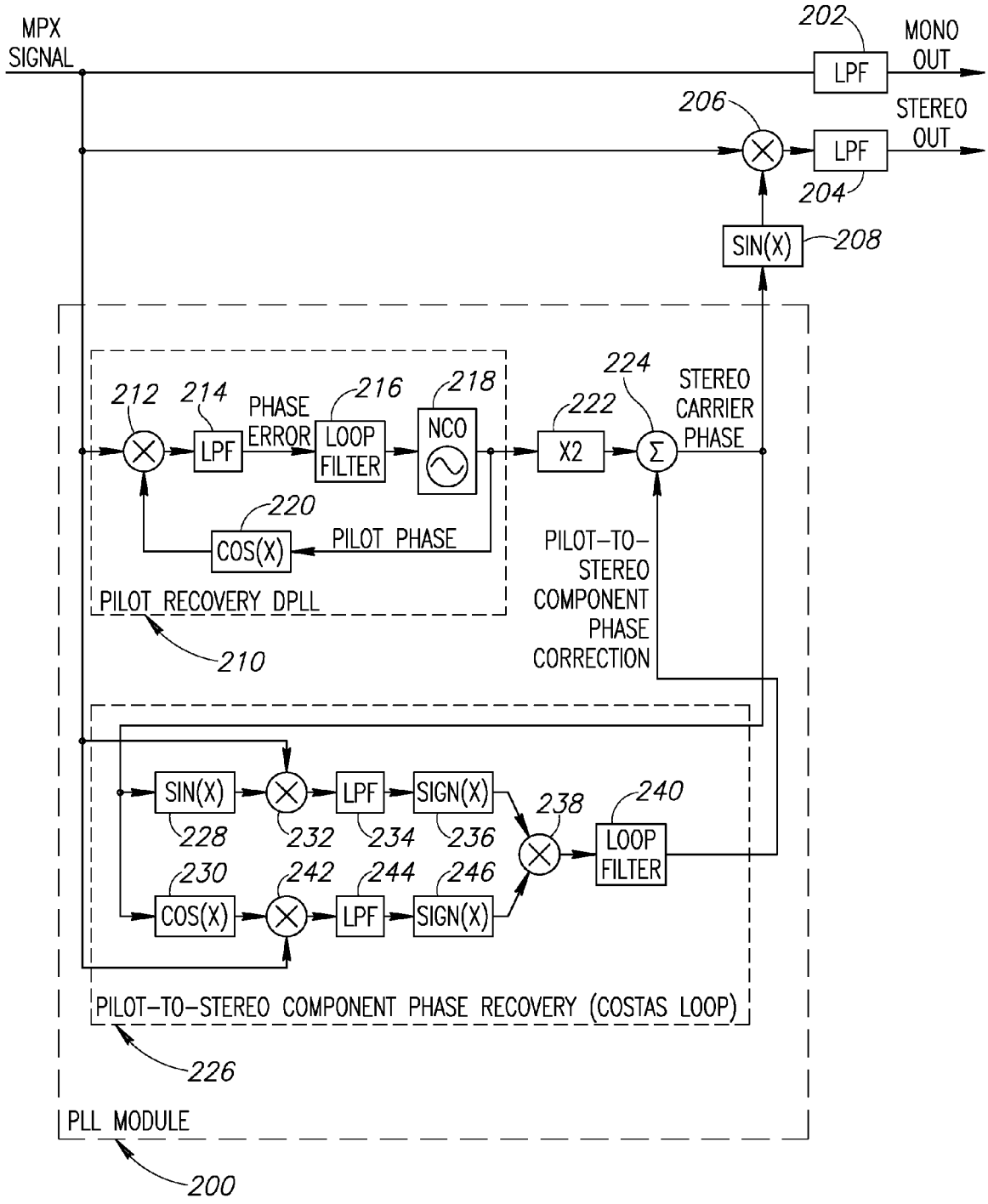
FIG. 6 is a block diagram illustrating an example phase locked loop (PLL) circuit constructed in accordance with the present invention in more detail.

The operation of the PLL module portion of the stereo decoder will now be described in more detail. A block diagram illustrating an example phase locked loop (PLL) module constructed in accordance with the present invention in more detail is shown in FIG. 6. The PLL module, generally referenced 200, comprises a pilot recovery digital phase locked loop (DPLL) 210, a pilot to stereo component phase recovery circuit (i.e. Costas loop) 226, frequency doubler 222 and adder 224. In a preferred implementation of the invention, the FM demodulator and stereo decoder circuitry are implemented digitally. Digital implementation, however, is not critical to the operation of the invention.

The pilot recovery DPLL 210, comprises a multiplier 212, low pass filter 214, loop filter 216, NCO 218 and cosine block 220. The DPLL is a digital second order phased locked loop used to recover the suppressed 38 kHz stereo component carrier from the stereo pilot 19 kHz wave to demodulate the stereo component. The pilot recovery loop is locked onto the phase of the pilot carrier component of the input MPX signal. Optionally, a gear-shift mechanism is used to apply different loop bandwidths in the loop's acquisition and tracking stage.

The loop filter consists of a proportional gain and an integrator to enable the PLL to track pilot frequency offset with no residual phase offset. A numerically controlled oscillator (NCO) 218 is applied to compute the carrier phase. Note that the NCO is effectively an integrator of the previously calculated loop filter output (i.e. instantaneous frequency offset). A high resolution sine table 125 (FIG. 5) is used to rebuild a high quality stereo carrier.

The presence of the pilot carrier wave is used as the indication of stereo component existence. The recovered carrier is coherent (i.e. same zero crossing times) to the transmitted pilot. The mono component (L+R) is generated by low pass filtering the MPX signal via LPF 202. The stereo component demodulated signal is generated by filtering, via LPF 204, the product of the MPX signal and the output of the sine table 208 generated via multiplier 206. Both outputs require low pass filtering in order to remove the pilot carrier wave, the alternate component and the RDS component.

The pilot to stereo component phase recovery loop or Costas loop 226 comprises a sine block 228, cosine block 230, multipliers 232, 242, 238, low pass filters 236, 246 and loop filter 240. The auxiliary Costas loop 226 is used to correct the phase error between the transmitted pilot and the stereo component carrier. Note that the ITU-R recommendation BS.450-3, cited supra, specifies that a 6 degree phase offset on the stereo component carrier is permitted. The use of the phase correction mechanism of the present invention significantly improves the Left to Right stereo audio channel separation. The pilot to stereo component phase recovery loop (i.e. Costas loop) is preferably activated immediately after the pilot recovery PLL becomes locked. The loop bandwidth of the Costas loop is preferably significantly narrower than that of the pilot recovery PLL in order that the Costas loop does not interfere with the pilot recovery PLL. The Costas loop is operative to track a residual phase error as high as several degrees.

In operation, the input MPX signal is multiplied by the cosine (cosine block 220) of the reconstructed pilot phase. The product then undergoes low pass filtering via LPS 214 in order to obtain the phase error. The loop filter 216 filters the phase error signal to obtain a frequency step for the NCO 218. The NCO accumulates its input to produce the pilot phase. This phase is also multiplied by two (block 222) in order to obtain the phase of the stereo component carrier.

The MPX signal is also multiplied (via multipliers 232, 242) by the sine (block 228) and cosine (block 230) of the doubled accumulated NCO angle summed with an angle correction generated by the Costas loop via adder 224. Both results are low pass filtered via LPFs 232, 244 and then multiplied via multiplier 238 to produce a signal proportional to the pilot to stereo component residual phase error. This residual phase error is then filtered by a second loop filter 240, which yields the Costas loop phase correction (i.e. pilot to stereo component phase correction). Note that optionally, the sign of the LPF outputs are used rather than the outputs themselves. Sign generator blocks 236, 246 function to determine the sign of the output of LPFs 234, 244, respectively.

As described supra, the PLL module rebuilds the stereo indication pilot carrier by locking a second order loop on its phase. The signals generated include twice the pilot phase, which is the stereo component carrier phase, the pilot phase itself as well as the loop phase error subsequently input to the loop filter. The phase difference estimation is performed by low pass filtering of the MPX input multiplied by the quadrature of the estimated pilot phase as follows:

$$PhaseDetector = \sin(\omega t)\cos(\omega t + \theta) = \frac{1}{2}(\sin(\theta) + \sin(2\omega t + \theta)) \tag{10}$$

Low pass filtering yields $$\sim \frac{1}{2}\sin(\theta) \approx \frac{1}{2}\theta$$

for small θ.

The stereo carrier phase is fed to a sine and cosine function (as cos(x)=sin (x+π/2)) whose outputs are multiplied with the MPX signal. Two low pass filters are used to remove the high frequency components. The sign functions 236, 246 are applied to remove the dependence of the phase correction on signal amplitude. The two signals are then multiplied and passed through a loop filter.

Mathematically, the MPX signal can be described as follows:

$$MPX(t)=M(t)+\sin(2\pi f_c t)+S(t)\sin(4\pi f_c t+\phi) \tag{11}$$

where

MPX(t) is the composite MPX signal voltage at time t

M(t) is the mono information signal

S(t) is the stereo information signal $f_c$ is the pilot frequency (19 kHz)

Assuming the PLL is locked, demodulation by cos ($4\pi f_c t$) and sin ($4\pi f_c t$) is performed. Therefore:

$$s_I(t)=M(t)\sin(4\pi f_c t)+\sin(2\pi f_c t)\sin(4\pi f_c t)+S(t)\sin(4\pi f_c t+\phi)\sin(4\pi f_c t)$$

$$s_Q(t)=M(t)\cos(4\pi f_c t)+\sin(2\pi f_c t)\cos(4\pi f_c t)+S(t)\sin(4\pi f_c t+\phi)\cos(4\pi f_c t) \tag{12}$$

where $s_I(t)$ and $s_Q(t)$ are the demodulated signals at both inphase and quadrature arms.

Assuming an integrate and dump process yields a good estimate of the DC component of the signal and filters out all the high frequency components, we obtain:

$$s_I^{I\&D}(t) = \frac{1}{2}S(t)\cos\phi \qquad s_Q^{I\&D}(t) = \frac{1}{2}S(t)\sin\phi \tag{13}$$

Therefore, multiplying the two yields:

$$s_I^{I\&D}(t)s_Q^{I\&D}(t) = \frac{1}{8}|S(t)|^2\sin 2\phi \approx \frac{1}{8}|S(t)|^2\cdot 2\phi \propto \phi \tag{14}$$

Taking the sign yields:

$$\text{sign}\{s_I^{I\&D}(t)s_Q^{I\&D}(t)\}=\text{sign}\{s_Q^{I\&D}(t)\}\cdot\text{sign}\{s_I^{I\&D}(t)\}=\text{sign}\{\phi\} \tag{15}$$

Equation 15 reveals that the detector is independent of the signal amplitude and phase and its output is the sign of the error phase φ. Note that since the loop filter contains an integrator it is able to generate a constant phase shift after the error in its input has converged to zero.

Thus, the pilot to stereo component phase recovery mechanism of the present invention effectively and without any prior knowledge about the stereo audio signal locks onto the stereo band residual phase error and corrects for it thus improving the overall signal quality as well as significantly improving stereo channel separation.

Figure 7:
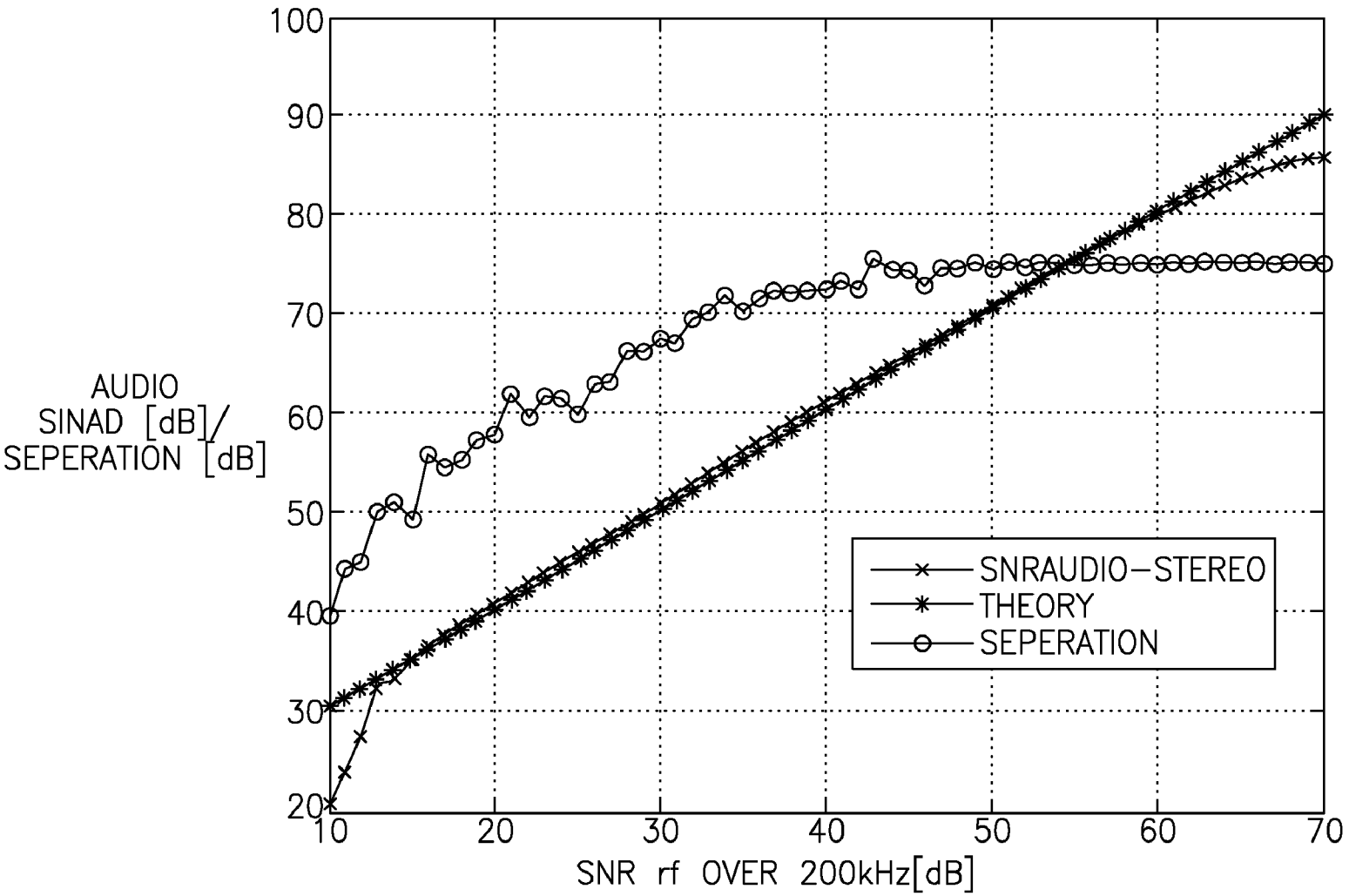
FIG. 7 is a graph illustrating the improved stereo channel separation performance achieved using the stereo decoder circuit of the present invention.

A graph illustrating the improved stereo channel separation performance achieved using the stereo decoder circuit of the present invention is shown in FIG. 7. In this graph, the channel separation is plotted versus the SNR of the RF signal. As shown in the graph, as the SNR of the signal increases, the channel separation also increases ultimately achieving a peak separation of 75 dB due to the use of the Costas loop in the PLL module portion of the stereo decoder.

In alternative embodiments, the methods of the present invention may be applicable to implementations of the invention in integrated circuits, field programmable gate arrays (FPGAs), chip sets or application specific integrated circuits (ASICs), DSP circuits, wired or wireless implementations and other communication system products.

It is intended that the appended claims cover all such features and advantages of the invention that fall within the spirit and scope of the present invention. As numerous modifications and changes will readily occur to those skilled in the art, it is intended that the invention not be limited to the limited number of embodiments described herein. Accordingly, it will be appreciated that all suitable variations, modifications and equivalents may be resorted to, falling within the spirit and scope of the present invention.

What is claimed is:

1. A method of decoding a stereo MPX signal, said method comprising the steps of:

recovering a pilot phase signal from said MPX signal;

generating a pilot-to-stereo component phase correction signal as a function of a stereo carrier phase signal and said MPX signal;

summing said pilot-to-stereo component phase correction signal with a frequency doubled pilot phase signal to yield said stereo carrier phase signal;

mixing said MPX signal with the sine of said stereo carrier phase signal to yield a stereo output signal.

2. The method according to claim 1, wherein said step of recovering comprises the step of applying a pilot carrier recovery technique to said MPX signal.

3. The method according to claim 2, wherein said pilot carrier recovery technique comprises the step of applying said MPX signal to a pilot recovery phase locked loop (PLL).

4. The method according to claim 1, wherein said step of generating comprises the step of applying said stereo carrier phase signal and said MPX signal to a Costas loop.

5. The method according to claim 1, further comprising the step of filtering said stereo output signal.

6. The method according to claim 1, wherein said stereo carrier phase signal comprises a sign indicating either a positive or negative phase.

7. The method according to claim 1, further comprising the step of filtering said MPX signal to yield a mono output signal.

8. A stereo MPX decoder, comprising:

a pilot recovery phase locked loop (PLL) circuit operative to generate a pilot phase error from an input MPX signal;

a pilot to stereo component phase recovery circuit operative to extract the phase difference between said MPX signal and a stereo carrier phase signal to yield a pilot to stereo component phase correction signal;

an adder for summing said pilot to stereo component phase correction signal with a frequency doubled pilot phase error signal to yield said stereo carrier phase signal; and a mixer operative to multiply said MPX signal with the sine of said stereo carrier phase signal to yield a stereo output signal therefrom.

9. The decoder according to claim 8, wherein said pilot to stereo component phase recovery circuit comprises a Costas loop circuit.

10. The decoder according to claim 8, wherein said pilot to stereo component phase recovery circuit comprises a Costas loop circuit, comprising:

a first multiplier operative to generate a first product of said MPX signal and the sine of said stereo carrier phase signal;

a second multiplier operative to generate a second product of said MPX signal and the cosine of said stereo carrier phase signal;

means for filtering and multiplying said first product and said second product to yield a third product therefrom; and a loop filter operative to filter said third product to yield said pilot to stereo component phase correction signal therefrom.

11. The decoder according to claim 10, wherein said Costas loop further comprises:

first means for extracting the sign of said first product;

second means for extracting the sign of said second product; and means for multiplying and filtering the sign of said first product and the sign of said second product.

12. The decoder according to claim 10, wherein said Costas loop circuit further comprises means for multiplying and filtering the sign of said first product with the sign of said second product to yield said pilot to stereo component phase correction signal.

13. The decoder according to claim 8, further comprising a low pass filter operative to filter said stereo output signal.

14. The decoder according to claim 8, further comprising a low pass filter operative to filter said MPX signal to yield a mono output signal therefrom.

15. A stereo MPX decoder, comprising:

a phase locked loop (PLL) circuit adapted to generate a pilot phase error from an input MPX signal;

a Costas loop circuit coupled to said PLL and operative to generate a phase correction signal representing the phase difference between a received stereo pilot carrier signal and an expected stereo pilot carrier signal;

compensating said received pilot carrier signal with said phase correction signal to yield a stereo carrier phase signal; and means for generating a stereo output signal as a function of said stereo carrier phase signal and said MPX signal.

16. The decoder according to claim 15, further comprising means for filtering said MPX signal to yield a mono output signal therefrom.

17. A stereo MPX decoder, comprising:

a phase locked loop circuit, comprising:

a pilot tone phase locked loop (PLL) circuit adapted to generate a pilot phase error from an input MPX signal;

a Costas loop circuit coupled to said PLL and operative to generate a phase correction signal representing the phase difference between a received stereo pilot carrier signal and an expected stereo pilot carrier signal;

compensating said received pilot carrier signal with said phase correction signal to yield a stereo carrier phase signal;

means for generating a stereo output signal as a function of said stereo carrier phase signal and said MPX signal;

a filter operative to generate a mono output signal from said MPX signal; and a stereo blend circuit operative to generate a left output signal and a right output signal from said mono output signal and said stereo output signal.

18. A frequency modulation (FM) radio, comprising:

an FM demodulator coupled to an antenna and operative to generate an MPX signal from an RF input signal received therefrom;

a MPX stereo decoder coupled to said FM demodulator, said MPX stereo decoder, comprising:

a phase locked loop (PLL) circuit adapted to generate a pilot phase error from an input MPX signal;

a Costas loop circuit coupled to said PLL and operative to generate a phase correction signal representing the phase difference between a received stereo pilot carrier signal and an expected stereo pilot carrier signal;

compensating said received pilot carrier signal with said phase correction signal to yield a stereo carrier phase signal;

means for generating a stereo output signal as a function of said stereo carrier phase signal and said MPX signal;

filter means for generating a mono output signal from said MPX signal; and a stereo blend circuit operative to generate a left output signal and a right output signal from said mono output signal and said stereo output signal.

19. The radio according to claim 18, wherein said Costas loop further comprises:

first means for extracting the sign of said first product;

second means for extracting the sign of said second product; and means for multiplying and filtering the sign of said first product and the sign of said second product.

20. The radio according to claim 18, wherein said Costas loop circuit further comprises means for multiplying and filtering the sign of said first product with the sign of said second product to yield said pilot to stereo component phase correction signal.

21. The radio according to claim 18, wherein said stereo output signal comprises the sum of a left audio signal and a right audio signal.

22. The radio according to claim 18, wherein said mono output signal comprises the difference between a left audio signal and a right audio signal.

* * * * *